US010633767B2

(12) United States Patent
De Jong et al.

(10) Patent No.: US 10,633,767 B2
(45) Date of Patent: Apr. 28, 2020

(54) CORD COMPRISING MULTIFILAMENT PARA-ARAMID YARN COMPRISING NON-ROUND FILAMENTS

(71) Applicant: TEIJIN ARAMID B.V., Arnhem (NL)

(72) Inventors: Jorrit De Jong, Arnhem (NL); Michel H. J. Van Den Tweel, Leusden (NL); Frederik Elkink, Arnhem (NL); Leonardus A. G. Busscher, Duiven (NL)

(73) Assignee: TEIJIN ARAMID B.V., Arnhem (NL)

( * ) Notice: Subject to any disclaimer, the term of this patent is extended or adjusted under 35 U.S.C. 154(b) by 107 days.

(21) Appl. No.: 15/564,569

(22) PCT Filed: Apr. 21, 2016

(86) PCT No.: PCT/EP2016/058888
§ 371 (c)(1),
(2) Date: Oct. 5, 2017

(87) PCT Pub. No.: WO2016/170050
PCT Pub. Date: Oct. 27, 2016

(65) Prior Publication Data

US 2018/0087188 A1 Mar. 29, 2018

(30) Foreign Application Priority Data

Apr. 22, 2015 (EP) ..... 15164655
Jul. 10, 2015 (EP) ..... 15176218

(51) Int. Cl.
*D01D 5/253* (2006.01)
*D01F 6/60* (2006.01)
(Continued)

(52) U.S. Cl.
CPC ..... *D01D 5/253* (2013.01); *D01F 6/605* (2013.01); *D02G 3/447* (2013.01); *D02G 3/448* (2013.01);
(Continued)

(58) Field of Classification Search
CPC ..... D01D 5/253; D01F 6/605; D02G 3/448; D02G 3/48; D10B 2331/021
(Continued)

(56) References Cited

U.S. PATENT DOCUMENTS 3,767,756 A 10/1973 Blades
3,869,429 A * 3/1975 Blades ..... C08G 69/02 264/184
(Continued)

FOREIGN PATENT DOCUMENTS

EP 0 021 484 A1 1/1981
EP 0021484 A1 * 1/1981 ..... D01F 6/605
(Continued)

OTHER PUBLICATIONS

Jul. 14, 2016 International Search Report issued in International Patent Application No. PCT/EP2016/058888.

*Primary Examiner* — Shaun R Hurley
*Assistant Examiner* — Patrick J. Lynch
(74) *Attorney, Agent, or Firm* — Oliff PLC

(57) ABSTRACT

A cord including multifilament para-aramid yarn comprising filaments, wherein the filaments have a non-round cross section having a smaller and a larger dimension, where the cross-sectional aspect ratio between the larger and the smaller dimension is 1.5-10 and the smaller dimension of the cross section has a maximum of 50 μm and wherein the para-aramid has at least 90% para bonds between the aromatic moieties. The cords have excellent fatigue properties.

8 Claims, 7 Drawing Sheets

(51) Int. Cl.
*D02G 3/44* (2006.01)
*D02G 3/48* (2006.01)
*D07B 1/02* (2006.01)

(52) U.S. Cl.
CPC ..... *D02G 3/48* (2013.01); *D07B 1/025* (2013.01); *D07B 2201/2003* (2013.01); *D07B 2201/2005* (2013.01); *D07B 2201/2009* (2013.01); *D07B 2205/205* (2013.01); *D10B 2331/021* (2013.01)

(58) Field of Classification Search
USPC ..... 428/397, 398, 399, 400
See application file for complete search history.

(56) References Cited

U.S. PATENT DOCUMENTS 5,246,776 A * 9/1993 Meraldi ..... D01F 6/605 152/451
5,378,538 A 1/1995 Makino et al.
5,565,507 A 10/1996 Marco et al.
5,616,683 A * 4/1997 Neuert ..... C04B 16/06 428/395
5,667,743 A 9/1997 Tai et al.
5,989,713 A * 11/1999 Naaman ..... B29C 70/16 428/358
2002/0034624 A1* 3/2002 Harpell ..... B29C 70/504 428/298.1
2003/0008582 A1* 1/2003 Koketsu ..... D01D 5/253 442/195
2005/0054762 A1* 3/2005 Yaginuma ..... C08K 5/5455 524/492
2006/0235104 A1* 10/2006 Hendriks ..... C08J 5/18 523/1
2012/0024769 A1* 2/2012 Martin ..... B01D 39/1615 210/198.1
2012/0184166 A1* 7/2012 Kurihara ..... D01F 6/80 442/181
2013/0240454 A1* 9/2013 Youngs ..... E02B 15/101 210/691
2013/0312638 A1* 11/2013 Parker ..... A61B 17/00234 106/156.2
2014/0130977 A1* 5/2014 Jaycox ..... D06M 15/55 156/307.5
2014/0363669 A1* 12/2014 Otto ..... D01F 9/12 428/367
2015/0038041 A1* 2/2015 Zhamu ..... D03D 15/0088 442/195
2015/0136294 A1* 5/2015 Lamontia ..... B60C 9/26 152/527

FOREIGN PATENT DOCUMENTS

EP 0 118 088 A1 9/1984
EP 0 374 356 A2 6/1990
EP 0 235 988 B1 7/1992
JP 2003-049388 A 2/2003
JP 2013-189734 A 9/2013

* cited by examiner

CORD COMPRISING MULTIFILAMENT PARA-ARAMID YARN COMPRISING NON-ROUND FILAMENTS

The present invention pertains to a cord comprising multifilament para-aramid yarn comprising non-round filaments, to the use of the cords and to a process to manufacture said cords comprising multifilament para-aramid yarn.

High performance yarns such as aramids are used as reinforcement material in many applications. Often, their high breaking strength is the reason for their application. During the lifetime of a product, static and dynamic stresses may occur that lead to a reduction of the yarn strength. This undesired process is known as 'fatigue'. The loss in strength needs to be compensated in the design of a product. The most direct approach is to increase the amount of reinforcement material, which will lead to an undesired weight increase and/or cost increase. Another option is to reduce the fatigue behavior of cords.

For tire reinforcement it is known that fatigue behavior of cords can be positively influenced by a) selecting yarns with lower Young's modulus, and b) using higher twist factors in the cord construction. For the specific case of para-aramid yarns, such as Twaron or Kevlar, it is known that spin conditions required to obtain lower modulus yarns, lead to lower breaking strength of yarn and related cords. Also higher twist factors are known to be detrimental to breaking strength. Strength reduction can be compensated by increasing the amount of reinforcement yarns, but this will lead to an undesired weight increase. Additionally, lower modulus yarns tend to give less stiff cords, which limits freedom in product design.

In conclusion, there is a need for cords comprising aramid yarns that offer improved end-of-life strength, within a broad modulus range.

Surprisingly, it has been found that such properties are shown by cords comprising multifilament yarns comprising filaments having a non-round cross section.

The present invention provides a cord comprising multifilament para-aramid yarn comprising filaments, wherein the filaments have a non-round cross section having a smaller and a larger dimension, where the cross-sectional aspect ratio between the larger and the smaller dimension is 1.5-10 and the smaller dimension of the cross section has a maximum of 50 μm and wherein the para-aramid has at least 90% para bonds between the aromatic moieties.

In the context of present invention para-aramid means an aramid having at least 90%, more preferably exclusively (i.e. 100%) para bonds between the aromatic moieties. Copolymers having also other than para bonds, such as copolyparaphenylene/3,4'-oxydiphenylene terephthalamide (Technora®) which contains for about 33% meta bonds, are not contained in the definition of para-aramid. Preferably the para-aramid is poly(para-phenylene terephthalamide) (PPTA).

The filaments within the multifilament yarn of the cords of the invention have a non-round cross section. A non-round cross section means that when observing the cross section, at least two dimensions of different length can be identified. These dimensions can be placed as theoretical axes in the cross section. Usually, the non-round filaments will be flat filaments such that two dimensions can be identified in the cross section, one being larger, i.e. in width direction of the filament, the other dimension being smaller, i.e. in the thickness direction of the filament.

The cross section of such filaments may be similar to the shape of a grain of rice, that is an oval cross section. This shape may also be referred to as flat, obround or rice shape. In one embodiment, the filaments have a more or less rectangular shaped cross section with rounded edges where the smaller and larger dimension are formed by two surfaces which are essentially parallel to each other.

The third dimension of the filaments is defined by the length of the filament. In continuous yarns, the third dimension (length) of the filaments will be by multitudes larger than the two dimensions of the cross section (width and thickness). In practice, the third dimension is limited only by the length of the yarn.

Yarns comprising non-round filaments have been described.

U.S. Pat. No. 5,378,538 describes yarns of co-poly(paraphenylene/3,4'-oxydiphenylene terephthalamide having non-round filaments. Such polymers are semi-rigid aromatic copolyamides and contain a large fraction of bonds which are responsible for a weak molecular extension. This copolymer yarn has different properties compared to para-aramid yarns as used in present invention.

U.S. Pat. No. 5,246,776 describes oblong monofilaments made from para-aramid. However, these monofilaments are large and have dimensions of e.g. 115×350 μm. Large monofilaments, even if assembled have different mechanical properties and are less suited for application in cords. For example, assemblies of 8 monofilaments of each a diameter of ca. 140 μm (ca. 210 dtex filament linear density) in rubber are too rigid and show inferior fatigue properties.

JP2003049388A is directed to a textile comprising para-aramid yarns having a flattened monofilament section. The aim of this invention is to produce flat fabrics for semiconductor boards.

JP2003049388A is completely silent on cords and on fatigue.

None of the prior art documents reveals or suggests a correlation between improved fatigue behavior of cords and the filament cross section.

The cross sectional aspect ratio of the filaments in the multifilament yarn used for the cords of present invention is between 1.5 and 10, preferably between 2 and 8, or between more than 2 or 2.5 and 6. In one embodiment the filaments have a cross sectional aspect ratio between 2.5, or even 3 or 3.5, and 7. In one embodiment, the filaments have a cross sectional aspect ratio of above 5. The cross sectional aspect ratio is the ratio between the width and the thickness of the filament, thus the ratio between the larger and the smaller dimension of the cross section.

The smaller dimension of the cross section generally is between 5 and 50 μm (thickness). That means that the maximum thickness of the filaments is 50 μm. In one embodiment the filaments of the multifilament PPTA yarn have a thickness of 5-30 μm, preferably 8-20 μm.

The larger dimension of the cross section, i.e. the width, is between 10 and 300 μm. Preferably, the larger dimension (width) has a maximum of 100 μm.

In a preferred embodiment, the filaments have a rectangular or oval shape and a cross section having a width of 20-60 μm and a thickness of 8-20 μm.

The linear density of the multifilament yarn and the filaments is comparable to the linear density of conventional multifilament yarns comprising round filaments. The linear density of the multifilament para-aramid yarn of the invention may be between 25 and 3500 dtex, preferably between 400 and 3400 dtex, more preferably between 800 and 2600 dtex, even more preferably between 900 and 1700 dtex.

Higher linear densities can be obtained by assembly of multiple yarns.

The linear density of the non-round filaments in the yarn according to the invention may vary between 0.5 and 130 dtex, preferably between 0.8-50 dtex, more preferably between 1.0-15 dtex per filament.

In one embodiment, the invention relates to the use of the cords comprising para-aramid multifilament yarn in tires, belts (e.g. conveyor belts), hoses, flowlines, umbilicals or ropes.

Usually, the cord or fabrics made thereof will be used as reinforcing element in such articles.

The cord according to the invention comprises multifilament para-aramid yarn having a non-round cross section. One or more than one multifilament yarn may be used to form the cord. A cord is characterized by the fact that it is twisted, on cord level and/or on yarn level.

This means, that the cord comprises 1, preferably at least 2 twisted or non-twisted multifilament yarns. Where the multifilament yarn is untwisted, the cord is twisted.

Usually, a cord comprises at least 2, 3, 4 or 5 multifilament yarns.

The linear density of the cord may vary according to the intended use. In general, a minimum cord linear density of 50 dtex and a maximum linear density of 100000 dtex may be mentioned. The linear density of the multifilament yarns to prepare the cord is chosen according to the use of the cord. For example, for tire cords, a yarn having a linear density of 25-16000 dtex is suitable, preferably 150-12000, more preferably 300-9000 dtex. For example tire cords for passenger cars might have a linear density of 400-7000 dtex, depending on the placement in the tire (e.g. carcass, bead). For hoses or umbilicals, yarns with a linear density of 150-20000 dtex, preferably 400-12000 dtex are suited. Such cords may have a linear density of 300-100000 dtex.

The multifilament yarn as used in present invention is a continuous strand or bundle comprising multiple filaments, usually at least 5 filaments, preferably at least 20 filaments, e.g. between 50 and 4000 filaments in the yarn as spun (thus before a potential assembly).

The cords of the invention may be used as such.

Although one single multifilament yarn can be used, the typical number of yarns combined in the cord is at least two. More yarns may also be combined in one cord. For example, up to 8 yarns may be combined in one cord.

The cords of the invention may be twisted. Typically, a minimum twist factor of 5 is used. The twist factor of the cords is defined according to BISFA "Terminology of man-made fibers", 2009 edition, such that:

$$TF = t^{*}\sqrt{\frac{LD}{\text{specific mass of polymer}\left(\frac{\text{kg}}{\text{m}^3}\right)}}$$

where TF=Twist Factor, t=Twist in turns per meter and LD=Linear density of the cord in tex. For aramid, the specific mass is typically 1440.

The twist factor of the cord may be as high as 1000, independent of the linear density of the yarns used to build the cord.

Preferably, the twist factor is 15-800, more preferably 25-500.

For example, for a tire cord a twist factor of 50-350 may be used.

Preferably, a cord according to the invention comprises at least 2 para-aramid multifilament yarns wherein the filaments have a non-round cross section and has a twist factor of the cord of 25-500, preferably 50-350, more preferably 100-280.

The yarns used to build the cord may be twisted. The yarns may have a twist of 0-3000 tpm (turns per meter), where lower linear density yarns typically have higher twist. When producing the cord, the yarns may be plied by removing the twist of each yarn such that the yarn present in the cord has a lower twist, no twist or even opposite twist per meter when compared to the starting material. The necessary equipment and methods of making twisted yarns and cords from fibrous materials are well known in the art. For example, the twisted cords of the present invention may be produced on ring-twist equipment, direct cabler or two-for-one twisting equipment. Twisting of cords can for example be done in multiple stages on different types of machines or in a single step. Cords can be symmetric, asymmetric, balanced or unbalanced and may be produced with or without overfeed of at least one of the yarns.

The cords of the invention comprise para-aramid multifilament yarn. The cords may be hybrid cords, and thus comprise also yarns made from a material other than para-aramid. For example, in a hybrid cord para-aramid multifilament yarn comprising filaments having a non-round cross section may be combined with one or more conventionally used yarns in cords, e.g. one or a mixture of the following yarns: elastane, carbon fibers, polyethylene fibers, polypropylene fibers, polyester fiber, polyamide fiber, cellulose fibers, polyketone fibers, meta aramid (e.g. TeijinConex), or aramid copolymer fibers (e.g. DAPBI, DAPE, cyano-PPD) or polybenzoxazole fiber (e.g. Zylon).

The cord of the present invention is suited for use in the reinforcement of various matrix materials, particularly elastomeric (e.g. rubber), thermoset or thermoplastic products, including cords used for the reinforcement of for example tires, hoses, flowlines, belts (e.g. conveyor belts, v-belts, timing belts) and umbilicals. The invention also pertains to the use of the cord of the invention for these applications.

In particular, the invention pertains to the use of cords as described in this specification in tires. Tires include but are not limited to automotive, airplane and truck tires.

For the various applications the cord may be treated with an adhesive composition to improve the adhesion between the cord and the matrix material.

For example, the cord may be dipped at least once in a resorcinol-formaldehyde-latex (RFL) adhesive.

Resorcinol-formaldehyde-free adhesive may also be used as e.g. described in EP0235988B1 and U.S. Pat. No. 5,565,507.

The cord may be treated with additional compositions to improve adhesion, e.g. epoxy or isocyanate based adhesives. A standard dipping procedure for cords is to pretreat the cord with an epoxy-based composition, after which RFL is applied in a second step. Subsequently, the matrix material may be applied.

The content of the adhesive composition based on the weight of cord is preferably in the range of 0-20 wt %, more preferably 2-10 wt %.

The cords of the invention have advantageous and surprising properties. Surprisingly, such cords show improved fatigue properties.

Fatigue means the strength loss when a cord is exposed to repeated stresses.

Optimal is a cord that retains its strength when exposed to repeated stresses.

There are different sorts of fatigue. A flexural fatigue test tests the response of a material to bending stress. To test the flexural fatigue properties, the material is exposed to repeated cycles of identical bending stress.

Block (or disc) fatigue refers to the tensile and/or compression fatigue behavior of cords in rubber.

The cords of the invention have improved fatigue properties with regard to flex fatigue and block fatigue. The Goodrich block fatigue test determines the tensile and/or compression fatigue of a material. The Goodrich block fatigue is determined by embedding a single cord in the center of a rubber block and this test specimen is cyclically extended and compressed.

The test is carried out on dipped para-aramid cords in accordance with ASTM D6588 under the conditions as given below. Testing takes place in a rubber compound. For the fatigue tests for current invention Master compound 02-8-1638 (a Standard Malaysian Rubber composition obtainable from QEW Engineered Rubber, Hoogezand, The Netherlands) was used as rubber compound. Preparation of the single cord per block for breaking force testing was done by cutting away the excess rubber. Retained strength levels are reported in Newtons.

Condition for Block or Disc Fatigue:

| | |
|---|---|
| Number of cords per block | 1 |
| Compression [C], (%) | 18% |
| Elongation [E], (%) | 2% |
| Running Times | 1.5, 6 and 24 hours |
| Frequency: | 40 Hz (2400 rpm) |
| Number of cycles: | 216k-cycles, 864k-cycles and 3.46M-cycles |

The fatigue behavior is analyzed for three different testing times: 1.5, 6 and 24 hours.

For each running time of the test the percentage retained strength was calculated based on the following equation: percentage retained strength=breaking strength of the dipped cord subjected to block or disc fatigue testing/breaking strength of the original dipped cord*100%.

The cords of the invention show an improved block fatigue compared to cords comprising yarns of the same titer but having round filaments.

The flex fatigue of the cords is tested by using the Akzo Nobel Flex Fatigue test (AFF test). A rubber strip approximately 25 mm wide is flexed around a spindle at a given load. The rubber strip comprises two cord layers, the upper tensile layer containing a material of very high modulus such as high-modulus para-aramid (e.g. Twaron™ D2200) and the lower cord layer which is situated closer to the spindle contains the cords to be tested. A schematic representation of the AFF test and the rubber strip is shown in FIG. 4. The high modulus tensile layer carries almost the full tensile load because of its comparatively high stiffness. The test cords of the bottom layer experience bending, deformation due to axial compression, and pressure from the upper cord layer. Bending and deformation in the presence of this lateral pressure causes degradation of the cord. After the strip has been flexed, the cords are carefully removed from the strip and the retained strength is determined using capstan clamps.

The retained strength values were measured both in Newtons and as a percentage of the original dipped cord breaking strength. The percentage is the ratio of the retained strength to the strength of the original dipped cord.

Flex Fatigue Test Conditions Used:

Stroke: 45 mm

Pulley load: 340N

Pulley diameter: 25 mm

Strap width: 25 mm

Strap length: approximately 44 cm

The cords of the invention show an improved flexural fatigue compared to cords comprising yarns of the same yarn linear density but having round filaments.

Hence, the invention also pertains to the use of cords according to the invention, and as described above and in claims 1 to 5, to improve the Goodrich block fatigue and/or flexural fatigue such that the relative retained strength of the cords is at least 10% higher, preferably at least 20% higher than the relative retained strength of cords comprising para-aramid yarns having the same yarn linear density but having a cross-sectional aspect ratio below 1.5. This effect is more pronounced with increasing exposure. For example, the above stated differences may be observed after an exposure time of at least 6 hours in the Goodrich block fatigue test.

The flexural fatigue is determined according to the Akzo Nobel Fatigue test as described below and the Goodrich block fatigue is determined in accordance with ASTM D6588. The relative retained strength of the cord is defined as the remaining tensile strength (determined according to ASTM D7269) after the fatigue test compared to the tensile strength of the cord before exposure to the test.

The invention also relates to a process to manufacture a cord comprising a multifilament para-aramid yarn comprising filaments, wherein the filaments have a non-round cross section having a smaller and a larger dimension, where the cross-sectional aspect ratio between the larger and the smaller dimension is 1.5-10, and wherein the para-aramid has at least 90% para bonds between the aromatic moieties, comprising the steps of:

i) dissolving the para-aramid in sulfuric add to obtain a dope;

ii) extruding the dope through a spinneret having multiple non-round nozzles to obtain a multifilament yarn;

iii) coagulating the multifilament yarn in an aqueous solution, iv) and combining at least two of the obtained multifilament yarns.

The spinning of multifilament para-aramid yarns having filaments with round cross section is known in the art. Reference is made to U.S. Pat. Nos. 3,767,756, 3,869,429 and in particular to EP0021484.

The spinneret is adapted to produce non-round filaments. In a preferred embodiment a spinneret with openings having a rectangular cross section is used.

The dimension of the nozzles are larger than the cross sectional dimensions of the filaments because of the drawing step during spinning and can vary between 10 and 250 micron for the hole thickness and 40-1000 micron for the hole width.

In the following, non-limiting examples the invention is further illustrated.

EXAMPLES

1. Preparation of Cords

Yarns of non-round shape were spun from PPTA dissolved in 99.8% $H_2SO_4$. For samples 1-3, the yarns were spun with a spinneret with rectangular holes with dimensions of 250×20 micron (504 openings). For samples 4-5, the same polymer solution was used but a spinneret with rectangular holes of 250×35 micron (252 openings). Resulting non-round filament yarn had filament dimensions with a width between 25-50 μm and a thickness between 8-16 μm for samples 1-3 and filament dimensions with a width of 9-18 μm and a thickness of 25-55 μm for samples 4-5. The different PPTA multifilament yarns according to the invention, having a non-round cross-section (oval, similar to a rice grain) and a cross sectional aspect ratio (CSAR) of ca. 3

(samples 1-3) and between 2.5 and 3.5 (samples 4-5, see indication below) were prepared having different moduli:

First Set of Experiments:

Sample 1: low nominal modulus (~60 GPa), 1680 dtex

Sample 2: medium nominal modulus (~80 GPa), 1680 dtex

Sample 3: high nominal modulus (~105 GPa) variant, 1680 dtex

As comparison two control multifilament yarns were prepared comprising filaments having a round cross section and having different nominal moduli:

Control 1: Twaron™ 1000 (~70 GPa), 1680 dtex

Control 2: Twaron™ 2100 (~60 GPa), 1680 dtex

Second Set of Experiments:

Sample 4: low nominal modulus (~55 GPa), 1680 dtex, CSAR: 3.5

Sample 5: low nominal modulus (~50 GPa) variant, 1680 dtex, CSAR: 2.5

As comparison two control multifilament yarns were prepared comprising filaments having a round cross section and having different nominal moduli:

Control 3: Twaron™ 1000 (~70 GPa), 1680 dtex

Control 4: Twaron™ 2100 (~60 GPa), 1680 dtex

Cords were prepared by twisting using a Saurer Allma CC2 direct cabler. Each cord was prepared from two PPTA yarns, each having a nominal linear density of 1680 dtex.

The yarns were comprised of round filaments (control 1-4) or non-round filaments (according to the invention, sample 1-5).

The cords were constructed as: 1680 dtex; x1Z330 x2S330 turns per meter Double bath dipping took place on an electrically heated Litzler single end Computreater with the following dipping sequence: pre-dip dip trough/drying/curing/RFL dip trough/curing.

Pre-dip drying conditions: 120 seconds at 150° C.

Pre-dip curing conditions: 90 seconds at 240° C.

RFL curing conditions: 90 seconds at 235° C.

Tension in each of the dip through steps: 2.5N

Tensions in all three ovens: 8.5N

Composition of the Pre-Dip:

| Chemicals: | Wet | Solids |
|---|---|---|
| (De-mineralized) water | 978.2 g | |
| Piperazine (water free) | 0.5 g | 0.5 g |
| Aerosol OT75% | 1.3 g | 1.0 |
| GE-100 epoxide | 20.0 g | 20.0 g |
| Total | 1000.0 g | 21.5 g |

Aerosol OT 75: Dioctyl sodium sulfosuccinate in 6% ethanol and 19% water (from Cytec Industries B.V.)

GE100 epoxide: Mixture of di- and trifunctional epoxided on the basis of glycidyl glycerin ether (from Raschig)

Composition of the RFL Dip:

| | | Wet | Solids |
|---|---|---|---|
| A. | (De-mineralized) water | 365.7 g | |
| | Ammonium hydroxide (25%) | 10.3 g | 2.6 g |
| | Penacolite R50 (50%) pre-condensed RF resin | 55.6 g | 27.8 g |
| B. | VP-latex Pliocord 106 (40%) | 407.0 g | 162.8 g |
| C. | Formaldehyde (37%) | 18.5 g | 6.8 g |
| | (De-mineralized) water | 142.9 g | |
| | Total | 1000.0 g | 200.0 g |

For the Twaron D2200 dipped cord used as tensile layer in the AFF test an RFL dip with the same relative composition but a 25% solids content was used.

Penacolite R50 (from Indspec Chemical Corporation)

Pliocord VP106 (from OMNOVA Solutions)

Directly after dipping of each of the cords, the dipped material was sealed in an air tight laminated aluminum bag to prevent deterioration of the RFL layer due to environmental exposure (ozone, moist etc.).

2. Determination of Properties of Yarns and Cords

The mechanical properties of the yarns and cords (undipped, dipped and after fatigue testing) were determined according to standard ASTM D7269-10 Standard Test Methods for Tensile Testing of Aramid Yarns 1. For dipped cords, for the determination of the breaking tenacity (BT) the linear density of the cords was corrected for the solids pick up due to the treatment with the adhesive.

Solids pick up is determined by means of the linear density method. From the linear weight of the dipped cord A (after conditioning for at least 16 hours at 20° C. and 65% R.H.) is subtracted the linear weight of the same cord B that has experienced the same dipping sequence but without the pre-dip and RFL dip (air-dipped), also after conditioning for at least 16 hours at 20° C. and 65% R.H. The percentage solids pick up is calculated as: (A−B)/B*100%.

The breaking toughness is defined as the surface area below the tensile curve, as defined in ASTM D885.

The linear density of yarns and cords was determined according to ASTM D1907.

The dimensions of the filaments are measured by embedding the yarn in resin and preparing sections by cutting perpendicular to the yarn extension direction. By optical microscopy the dimensions of the filament cross section are determined.

Twist Efficiency

The twist efficiency is determined based on the breaking tenacities (BT) of the original yarn from which the twisted yarn or cord is made:

Twist efficiency (%, tenacity based) TE-T=Breaking Tenacity of the twisted yarn or cord/original breaking tenacity of the original yarn.

The twist efficiency indicates how much of the original yarn tenacity is retained in the cord construction.

Twist-dip efficiency (%, tenacity based) TDE-T=Breaking Tenacity of the dipped twisted yarn or cord/original breaking tenacity of the original yarn.

The twist-dip efficiency indicates how much of the original yarn tenacity is retained in the dipped twisted cord construction.

The Goodrich block fatigue is determined for dipped para-aramid cords in accordance with ASTM D6588. The cords are embedded in a rubber compound Master compound 02-8-1638 available from QEW Engineered Rubber, Hoogezand, The Netherlands. Prior to use of the Master compound, curatives must be added and mixed. These curatives are 0.9 phr N-cyclohexyl-2-benzothiazylsulfenamide (CBS-powder) and 4 phr insoluble sulfur added to 179 phr Master compound. Mixing took place on a 2-roll mill.

Vulcanization conditions used are 18 minutes at 150° C. in an electrical heated press at a pressure of 18 tons. The mold is not pre-heated. Condition for block fatigue test:

| | |
|---|---|
| Number of cords per block | 1 |
| Compression [C], (%) | 18% |
| Elongation [E], (%) | 2% |
| Running Times | 1.5, 6 and 24 hours |
| Frequency: | 40 Hz (2400 rpm) |
| Number of cycles: | 216k-cycles, 864k-cycles and 3.46M-cycles |

Per running time, the percentage retained strength was calculated based on the following equation: percentage retained strength=breaking strength of the dipped cord subjected to block or disc fatigue testing/breaking strength of the original dipped cord*100%.

The flexural fatigue of the cords was determined with the Akzo Nobel Flex Fatigue test. A rubber strip approximately 25 mm wide is flexed around a spindle at a given load. The rubber strip comprises two cord layers, the upper tensile layer containing a material of very high modulus (Twaron™ D2200 was used) and the lower cord layer which is situated closer to the spindle contains the cords to be tested. The cords are embedded in the rubber compound "Master compound 02-8-1638" available from QEW Engineered Rubber, Hoogezand, The Netherlands. Prior to use of the Master compound, curatives must be added and mixed with the Master compound. As curatives were used 0.9 phr N-cyclohexyl-2-benzothiazylsulfenamide (CBS-powder) and 4 phr insoluble sulfur added to 179 phr Master compound. Mixing took place on a 2-roll mill. A schematic presentation of the rubber strip and the test set-up is given in FIG. 4. The Twaron™ D2200 tensile layer carries almost the full tensile load because of its comparatively high stiffness. The test cords of the bottom layer experience bending, deformation due to axial compression, and pressure from the upper cord layer.

Rubber strip building (in layers on top of each other): 1 mm Master compound 02-8-1638/8 dipped test cords (as described above) with a spacing of 2 mm center to center/1 mm Master compound 02-8-1638/tensile layer of double bath dipped cords Twaron™ D2200, 1610 dtex x1Z200, x25200/2 mm Master compound 02-8-1638. The 1 mm Master compound side is facing the pulley. Vulcanization conditions used are 18 minutes at 150° C. in an electrical heated press at a pressure of 18 tons. The mold is not pre-heated.

The production of the tensile layer cord was done on Lezzeni ring twist equipment. Dipping of the cord from the tensile layer (Twaron D2200 cords) is identical to that of the sample and control cords with the only exception that RFL was used with a concentration of 25%.

Tensile layer end-count: is 28 cords per inch.

Bending and deformation in the presence of the lateral pressure causes degradation of the cord. After the strip has been flexed, the cords are carefully removed from the strip (e.g. with a splitter device from e.g. Fortuna—Werke GmbH type UAF 470) and the retained strength of the cords is determined using capstan clamps. The retained strength values were measured both in Newtons and as a percentage of the original dipped cord breaking strength. The percentage is the ratio of the retained strength to the strength of the original dipped cord.

Flex Fatigue Test Conditions Used:

Stroke: 45 mm

Pulley load: 340N

Pulley diameter: 25 mm

Strap width: 25 mm

Strap length: approximately 44 cm

Running time: 2 hours (36 kcycles)

Bend of the strap over the pulley: 172°±5°

PRS (percentage retained strength) is calculated based on original dipped cord breaking strength.

Experiment 1: Properties of the Yarns and Cords of the Invention of Samples 1-3

The properties of the multifilament yarns of samples 1-3 and controls 1-2 are shown in table 1.

TABLE 1

| Property | Sample 1 "60 GPa" | Sample 2 "80 GPa" | Sample 3 "105 GPa" | Control 1 "70 GPa" | Control 2 "60 GPa" |
|---|---|---|---|---|---|
| Linear density (dtex) | 1711 | 1698 | 1680 | 1727 | 1708 |
| Breaking strength (N) | 327 | 336 | 322 | 359 | 369 |
| Elongation at break (%) | 3.89 | 3.26 | 2.56 | 3.53 | 4.17 |
| BS loss compared to Control 1 (%) | 9 | 6 | 10 | | |
| BS loss compared to Control 2 (%) | 11 | 9 | 13 | | |
| Breaking tenacity (mN/tex) | 1911 | 1979 | 1919 | 2076 | 2159 |
| Breaking toughness (J/g) | 34.9 | 30.9 | 24.1 | 34.9 | 42.6 |
| Chord Modulus (GPa) | 57.5 | 77.6 | 103.1 | 73.1 | 61.3 |
| Cross sectional shape | Rice grain | Rice grain | Rice grain | Round | Round |

(BS: breaking strength)

As can be seen from the data of table 1 the multifilament yarn of the invention comprising non-round filaments lack some breaking strength in comparison to the control yarns which comprise conventional round filaments, for all 3 examples of experiment 1. Also, the samples according to the invention cover a wide modulus range.

Subsequently, cords were prepared from the above described yarns. Each cord (1680 dtex x2, Z330/S330) was made from two multifilament yarns, each yarn having a twist (one positive and one negative) of ca. 330 turns per meter and the cord having a twist factor of ca. 165.

The properties of the undipped cords are shown in table 2.

TABLE 2

| Property | Sample 1 "60 GPa" | Sample 2 "80 GPa" | Sample 3 "105 GPa" | Control 1 "70 GPa" | Control 2 "60 GPa" |
|---|---|---|---|---|---|
| Linear density (dtex) | 3703 | 3659 | 3622 | 3723 | 3674 |
| Breaking strength (N) | 501 | 512 | 504 | 561 | 576 |
| BS loss compared to Control 1 (%) | 13 | 9 | 10 | | |
| BS loss compared to Control 2 (%) | 13 | 11 | 13 | | |
| Elongation at break (%) | 5.66 | 5.03 | 4.49 | 5.43 | 6.07 |
| Breaking tenacity (mN/tex) | 1353 | 1399 | 1393 | 1507 | 1569 |
| Breaking toughness (J/g) | 31 | 28.4 | 24.9 | 33.6 | 38.9 |
| Chord Modulus (GPa) | 28.5 | 33.7 | 39.6 | 32.1 | 28.6 |
| Twist efficiency (%) | 71 | 71 | 73 | 73 | 73 |

The undipped cords according to the invention have a lower breaking strength compared to the control cords. This loss of strength is even more pronounced in the cords, compared to the difference in breaking strength of the control yarns. Therefore, the cords according to the invention usually have an equal to lower twist-efficiency than cords comprising multifilament yarns having round filaments. Surprisingly, this is different in the multifilament yarns made of co-poly-para-phenylene/3,4'-oxydiphenylene terephthalamide having non-round filaments as described in U.S. Pat. No. 5,378,538.

Such cords have a better twist efficiency (utilization in tenacity) compared to yarns of the same polymer but having round filaments, even at different twist levels.

The sample and control cords were dipped according to the above described process and the cord properties were determined (table 3).

TABLE 3

| Property | Sample 1 | Sample 2 | Sample 3 | Control 1 | Control 2 |
|---|---|---|---|---|---|
| Linear density (dtex) | 3743 | 3734 | 3774 | 3803 | 3753 |
| Breaking strength (N) | 513 | 513 | 492 | 595 | 608 |
| BS loss compared to Control 1 (%) | 14 | 14 | 17 | | |
| BS loss compared to Control 2 (%) | 16 | 16 | 19 | | |
| Elongation at break (%) | 4.84 | 4.21 | 3.86 | 4.9 | 5.39 |
| Breaking tenacity (mN/tex) | 1450 | 1460 | 1395 | 1669 | 1722 |
| Breaking toughness (J/g) | 31.7 | 27.7 | 23.7 | 36.5 | 41.6 |
| Chord Modulus (GPa) | 34.6 | 40.8 | 42.7 | 38.3 | 35.9 |
| Twist-dip efficiency (%) | 78 | 76 | 76 | 83 | 83 |

The dipped cords according to the invention (samples 1-3) have a substantially lower breaking strength (BS) compared to the control cords. In comparison with the yarns and the cords, the BS loss of the dipped sample cords in comparison to the controls are more pronounced due to lower twist-dip efficiencies. The twist-dip efficiency of the dipped cords according to the invention is lower than of the control cords, this is even more pronounced for the dipped cords than the untreated cords (see Table 2). Surprisingly, dipped cords comprising multifilament yarns made of co-poly-para-phenylene/3,4'-oxydiphenylene terephthalamide and having non-round filaments as described in U.S. Pat. No. 5,378,538 have a higher twist-dip efficiency than cords comprising multifilament yarn having round filaments and made from the same polymer.

The dipped cords were used in the Goodrich Block Fatigue test and in the Akzo Nobel Flex Fatigue test to determine their fatigue behavior.

Surprisingly, the Goodrich Block Fatigue test shows a clear difference between the sample cords and the control cords. The sample cords (according to the present invention) have a higher absolute retained strength already after 1.5 hours of block fatigue testing than the control cords comprising round filaments even though the original dipped cord strengths of the samples were at least 14% lower than those of the controls. This unexpected effect is depicted in FIG. 1*a*.

FIG. 1*b* shows the Goodrich Block Fatigue results of the tested cords for different test running times, i.e. stress exposure times (1.5, 6 or 24 hours). The effect can be observed at all time points, especially after 24 hours of testing. This indicates that the yarns and cords according to the invention can delay the process of block fatigue effectively.

FIG. 2 shows the relative retained strength (GBF-PRS) of the sample and control cords. All cords according to the invention have a higher relative retained strength, thus a lower fatigue, than the control cords. This applies for cords of the invention irrespective of their modulus, however, the effect is more pronounced for cords with a lower modulus.

Also the Akzo Nobel Flex Fatigue (AFF) of the cords according to the invention is better than of the control cords. As can be seen in FIGS. 3*a* and 3*b*, the (percentage) retained strength of the sample cords is much higher than the (percentage) retained strength of the control cords.

Experiment 2: Properties of the Yarns and Cords of the Invention of Samples 4-5

The properties of the multifilament yarns of samples 4-5 and controls 3-4 are shown in table 4.

TABLE 4

| Property | Sample 4 "55 GPa" | Sample 5 "50 GPa" | Control 3 "70 GPa" | Control 4 "60 GPa" |
|---|---|---|---|---|
| Linear density (dtex) | 1729 | 1723 | 1719 | 1715 |
| Breaking strength (N) | 308 | 307 | 361 | 366 |
| Elongation at break (%) | 3.91 | 4.25 | 3.56 | 4.10 |

TABLE 4-continued

| Property | Sample 4 "55 GPa" | Sample 5 "50 GPa" | Control 3 "70 GPa" | Control 4 "60 GPa" |
|---|---|---|---|---|
| BS loss compared to Control 3 (%) | 15 | 15 | | |
| BS loss compared to Control 4 (%) | 16 | 16 | | |
| Breaking tenacity (mN/tex) | 1783 | 1784 | 2100 | 2133 |
| Breaking toughness (J/g) | 33.0 | 36.0 | 35.8 | 41.6 |
| Chord Modulus (GPa) | 53.5 | 48.5 | 73.4 | 61.7 |
| Cross sectional shape | Rice grain | Rice grain | Round | Round |

(BS: breaking strength)

As can be seen from the data of table 4, similarly to samples 1-3, the non-round yarns according to the invention have lower breaking strength compared to the control yarns comprising round filaments.

Subsequently, cords were prepared from the above described yarns. Each cord (1680 dtex x2, Z330/S330) was made from two multifilament yarns, each yarn having a twist (one positive and one negative) of ca. 330 turns per meter and the cord having a twist factor of ca. 165. The undipped cord properties are shown in table 5.

TABLE 5

| Property | Sample 4 "55 GPa" | Sample 5 "50 GPa" | Control 3 "70 GPa" | Control 4 "60 GPa" |
|---|---|---|---|---|
| Linear density (dtex) | 3713 | 3687 | 3678 | 3651 |
| Breaking strength (N) | 439 | 415 | 559 | 582 |
| Elongation at break (%) | 5.65 | 5.59 | 5.36 | 6.05 |
| BS loss compared to Control 3 (%) | 21 | 26 | | |
| BS loss compared to Control 4 (%) | 25 | 29 | | |
| Breaking tenacity (mN/tex) | 1182 | 1125 | 1520 | 1594 |
| Breaking toughness (J/g) | 26.7 | 26.3 | 33.8 | 40.0 |
| Chord Modulus (GPa) | 26.7 | 24.9 | 32.8 | 29.3 |
| Twist efficiency (%) | 66 | 63 | 72 | 75 |

Again, the undipped cords according to the invention have lower breaking strength compared to the control cords. The twist efficiency of the sample cords is again lower than of the control cords, which is different in the multifilament yarns made of co-poly-para-phenylene/3,4'-oxydiphenylene terephthalamide having non-round filaments as described in U.S. Pat. No. 5,378,538

The sample and control cords were dipped according to the above described process and the cord properties were determined (table 6).

TABLE 6

| Property | Sample 4 "55 GPa" | Sample 5 "50 GPa" | Control 3 "70 GPa" | Control 4 "60 GPa" |
|---|---|---|---|---|
| Linear density (dtex) | 3573 | 3550 | 3545 | 3530 |
| Breaking strength (N) | 472 | 454 | 593 | 592 |
| Elongation at break (%) | 4.90 | 4.94 | 4.87 | 5.54 |
| BS loss compared to Control 3 (%) | 20 | 23 | | |
| BS loss compared to Control 4 (%) | 20 | 23 | | |
| Breaking tenacity (mN/tex) | 1321 | 1278 | 1673 | 1678 |

TABLE 6-continued

| Property | Sample 4 "55 GPa" | Sample 5 "50 GPa" | Control 3 "70 GPa" | Control 4 "60 GPa" |
|---|---|---|---|---|
| Breaking toughness (J/g) | 31.3 | 29.0 | 38.8 | 42.2 |
| Chord Modulus (GPa) | 34.0 | 30.6 | 41.2 | 34.6 |
| Twist-dip efficiency (%) | 74.2 | 71.6 | 79.5 | 78.6 |

Surprisingly, dipped cords comprising multifilament yarns made of co-poly-para-phenylene/3,4'-oxydiphenylene terephthalamide and having non-round filaments as described in U.S. Pat. No. 5,378,538 have a higher twist-dip efficiency than cords comprising multifilament yarn having round filaments and made from the same polymer.

The dipped cords were used in the Goodrich Block Fatigue test (FIG. 4) and the Akzo Nobel Flex Fatigue test (FIG. 5) to determine their fatigue behavior.

Again, the sample cords show an improved fatigue behavior compared to cords comprising para-aramid multifilament yarns comprising filaments with a round cross section. As can be seen from FIGS. 4 and 5, even though the sample cords 4 and 5 start at a lower absolute strength, during the block fatigue test, they loose relatively little strength compared to the control cords. Thus, the sample cords show better block fatigue behavior. Also the flex fatigue behavior is better than that of control cords comprising round filaments (FIG. 6).

In conclusion, even though the yarns and the untreated and dipped cords according to the invention initially have a lower breaking strength, the cords show an improved block and flexural fatigue behavior under stress compared to conventional cords having the same cord and yarn linear density but comprising filaments having a round cross section. Surprisingly, after compression and bending stress the absolute value of the remaining breaking strength of the cords of the invention is higher than that of conventional cords comprising filaments with a round cross section. Therefore, the cords of the invention are especially suited for applications where compression and/or bending stresses occur.

Figure 1A:
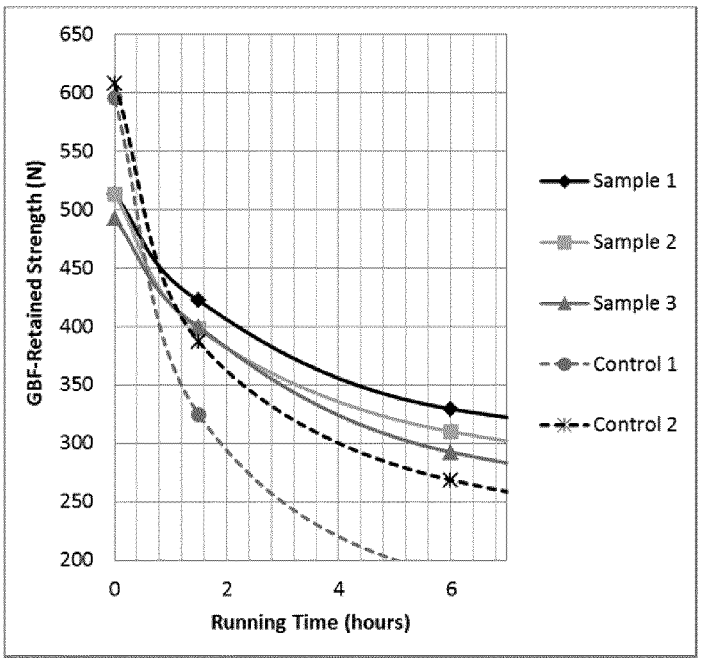
FIG. 1 shows the results of the Goodrich Block fatigue test as absolute retained strength for shorter testing times (FIG. 1*a*) and longer testing times (FIG. 1*b*) for samples 1-3 and controls 1-2.
Figure 1B:
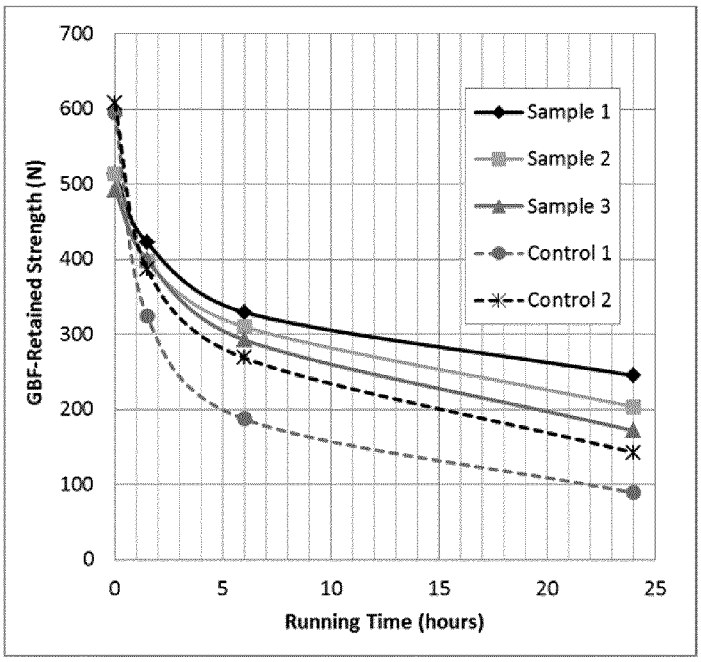
Figure 2:
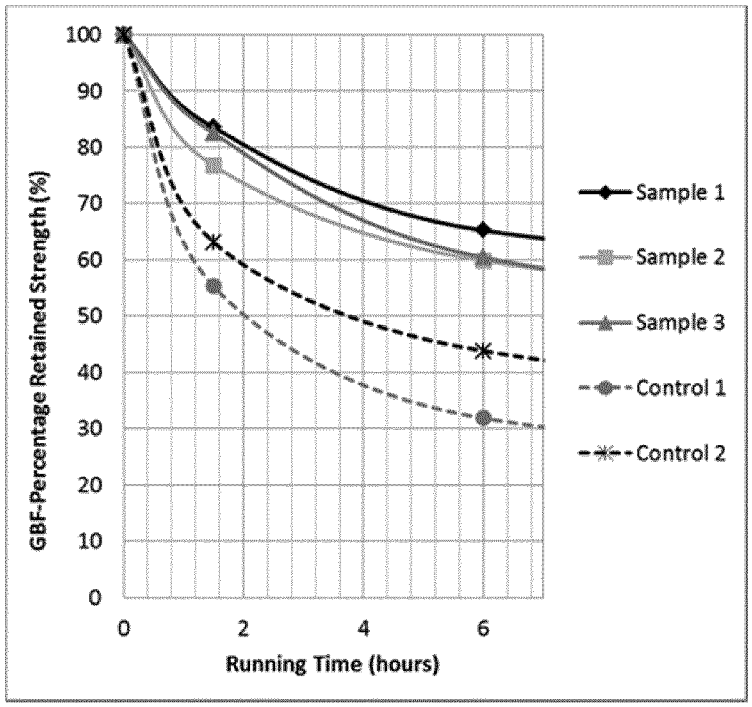
FIG. 2 shows the results of the Goodrich Block fatigue test as relative retained strength compared to the cord strength before stress exposure for samples 1-3 and controls 1-2.
Figure 3A:
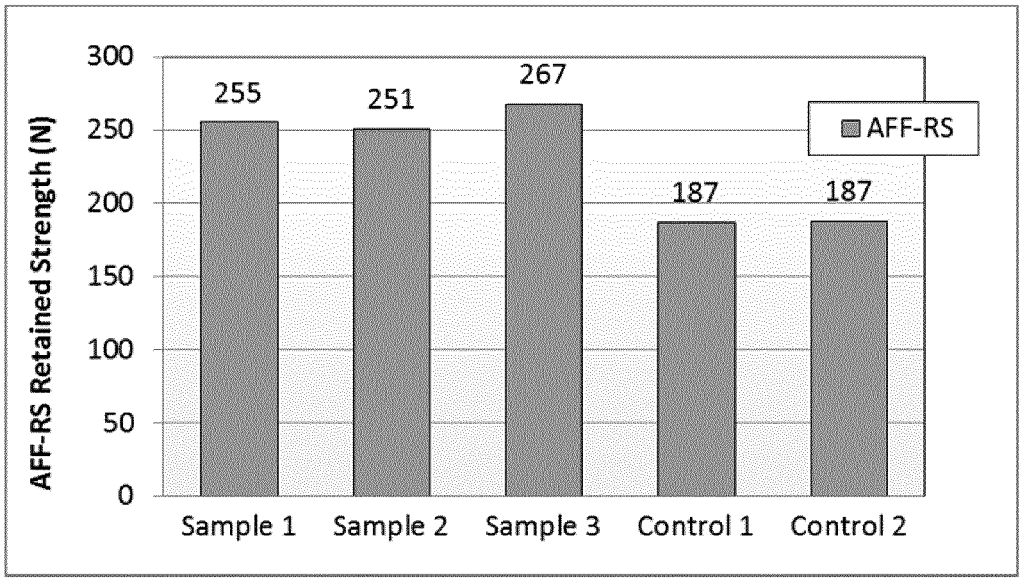
FIG. 3 shows the results of the AFF test as absolute retained strength of cords (FIG. 3*a*) and relative retained strength (FIG. 3*b*) the for samples 1-3 and controls 1-2.
Figure 3B:
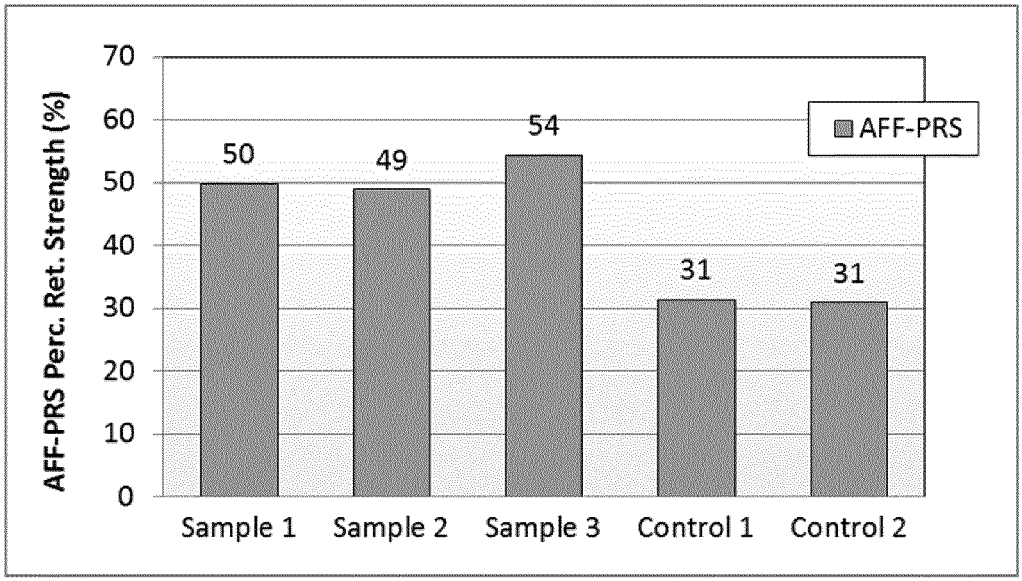
Figure 4A:
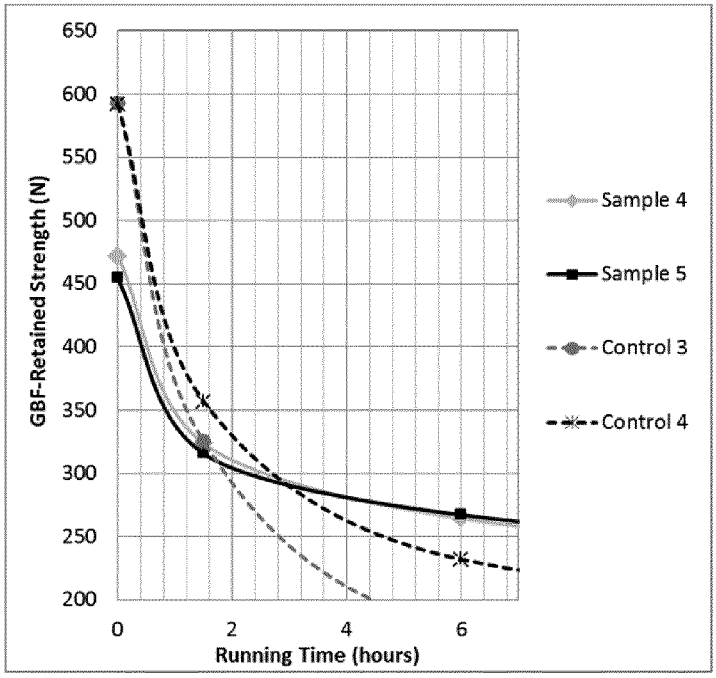
FIG. 4 shows the results of the Goodrich Block fatigue test as absolute retained strength for shorter testing times (FIG. 4*a*) and longer testing times (FIG. 4*b*) for samples 4-5 and controls 3-4.
Figure 4B:
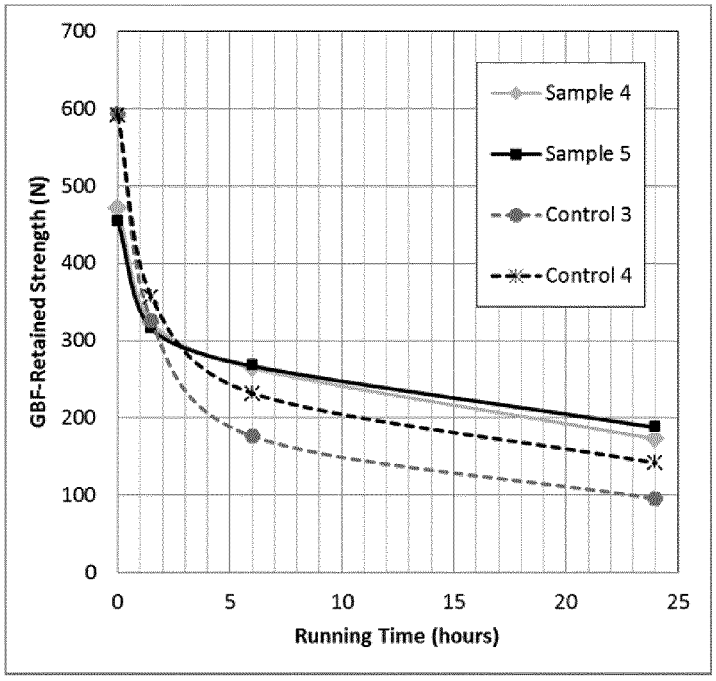
Figure 5:
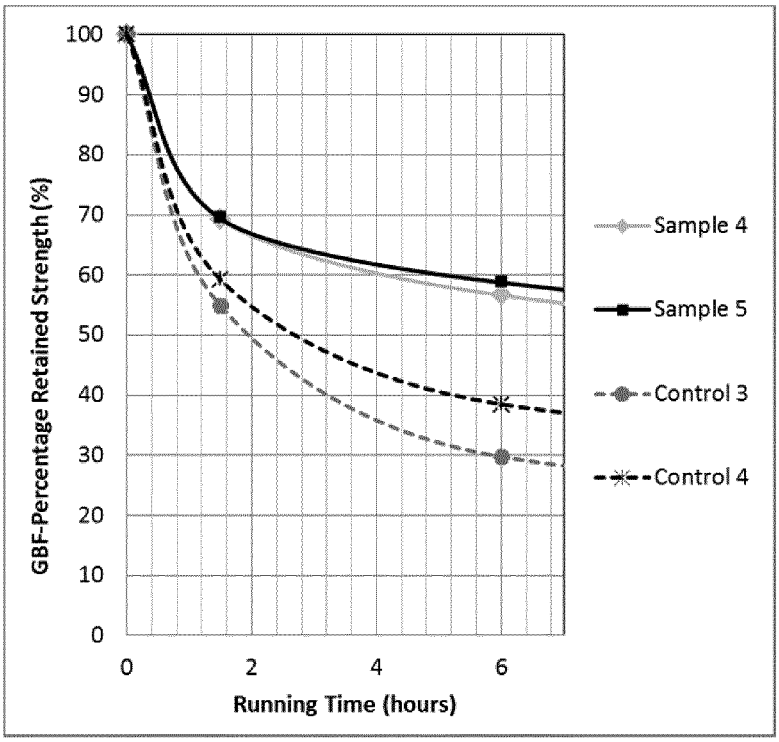
FIG. 5 shows the results of the Goodrich Block fatigue test as relative retained strength compared to the cord strength before stress exposure for samples 4-5 and controls 3-4.
Figure 6A:
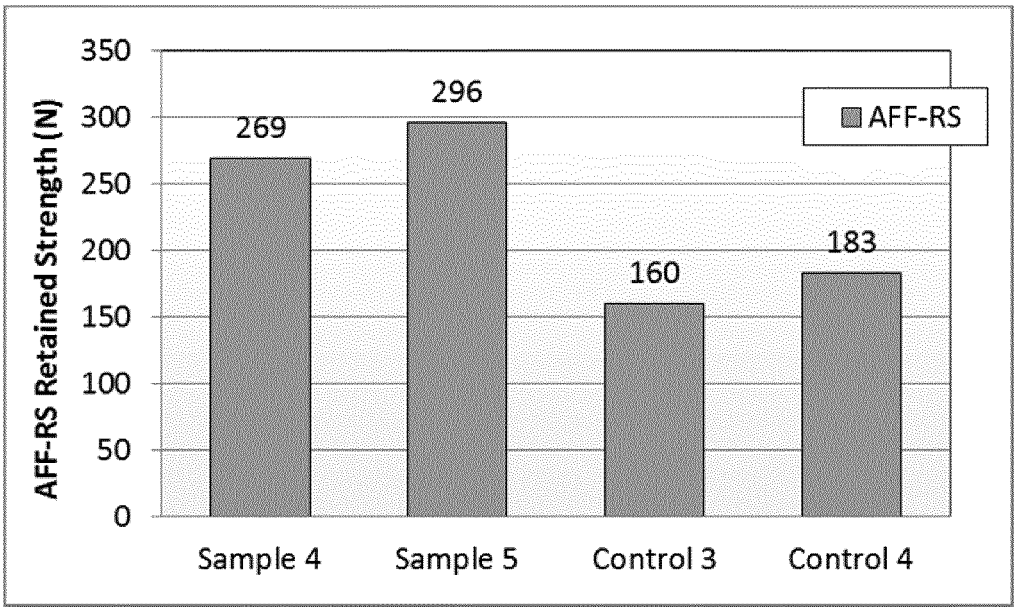
FIG. 6 shows the results of the AFF test as absolute retained strength of cords (FIG. 6*a*) and relative retained strength (FIG. 6*b*) the for samples 4-5 and controls 3-4.
Figure 6B:
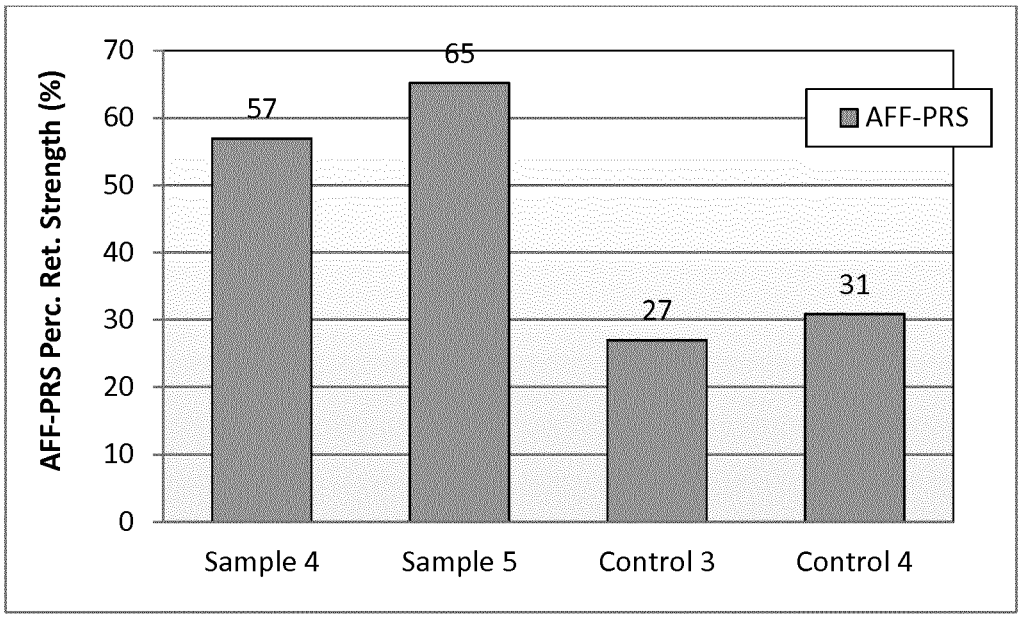
Figure 7A:
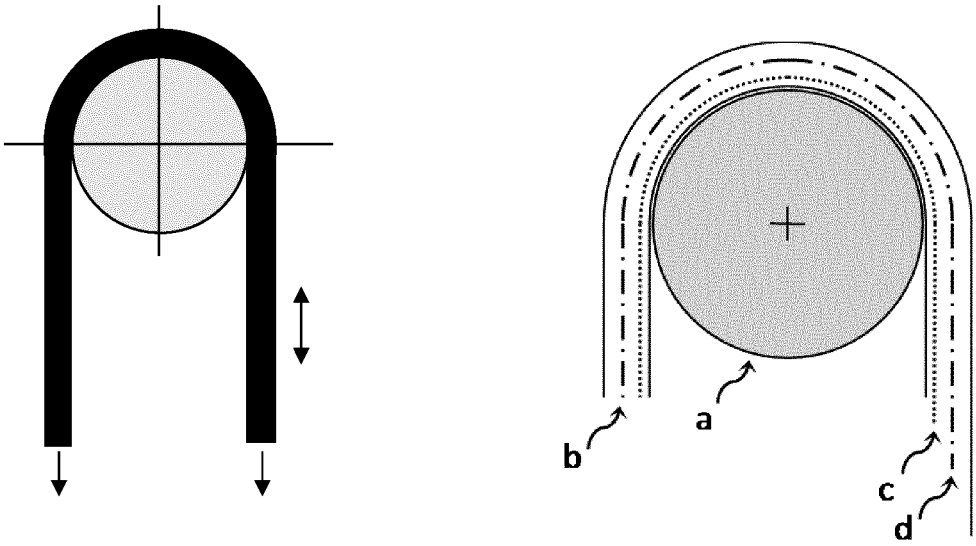
FIG. 7 shows a schematic overview of the test set-up of the AFF test (FIG. 7*a*) and the rubber strip that is used in the AFF test (FIG. 7*b*). a=25 mm diameter pulley, b=AFF strap, c=layer of test cords, n=8, d=layer of tensile cords (Twaron D2200).
Figure 7B:
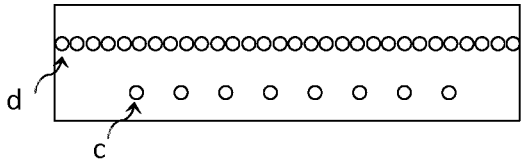
Figure 8:
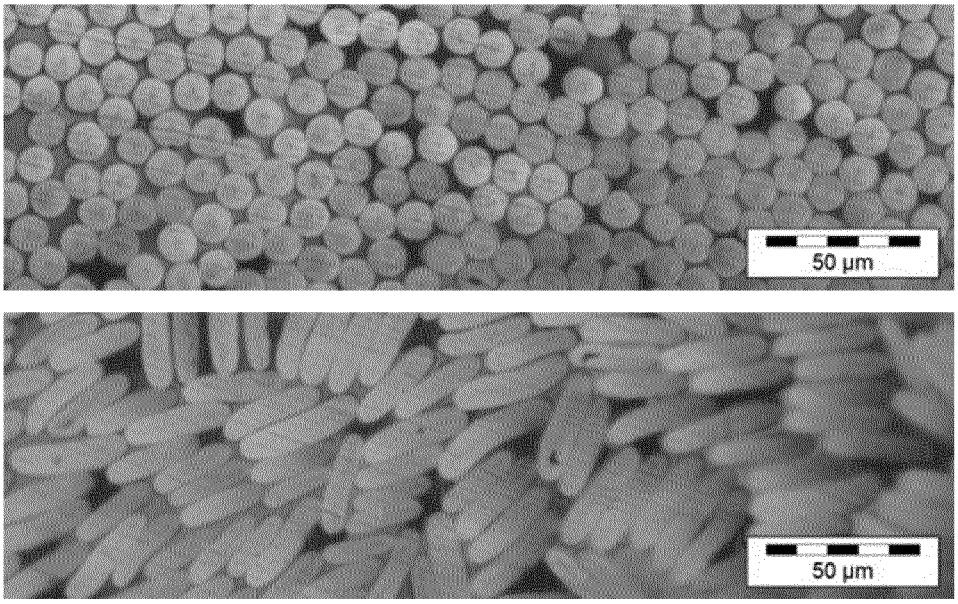
FIG. 8 shows a cross section of the multifilament para-aramid yarn of the invention (lower panel) and of conventional multifilament yarn (upper panel).

The invention claimed is:

1. Cord comprising a multifilament para-aramid yarn comprising filaments, wherein the filaments have a non-round cross section having a smaller dimension and a larger dimension, where a cross-sectional aspect ratio between the larger dimension and the smaller dimension is in a range from 1.5 to 10 and the smaller dimension of the cross section has a maximum thickness of 50 μm, wherein the para-aramid has at least 90% para bonds between the aromatic moieties, and wherein the cord comprises a resorcinol-formaldehyde-latex adhesive.

2. Cord of claim 1, wherein the cross-sectional aspect ratio between the larger dimension and the smaller dimension is in the range from 2 to 8.

3. Cord of claim 1, wherein the larger dimension has a maximum length of 100 μm.

4. Cord of claim 1, wherein the para-aramid yarn is para-phenylene terephthalamide yarn.

5. Cord of claim 1, having a linear density of at least 25 dtex.

6. A tire, belt, hose, flowline, rope or umbilical incorporating the cord of claim 1.

7. Process to manufacture a cord comprising multifilament para-aramid yarn comprising filaments, wherein the filaments have a non-round cross section having a smaller dimension and a larger dimension, where a cross-sectional aspect ratio between the larger dimension and the smaller dimension is in a range from 1.5 to 10 and the smaller dimension of the cross section has a maximum thickness of 50 μm, wherein the para-aramid has at least 90% para bonds between the aromatic moieties, and wherein the cord comprises a resorcinol-formaldehyde-latex adhesive, comprising the steps of: i) dissolving the para-aramid in sulfuric acid to obtain a dope; ii) extruding the dope through a spinneret having multiple non-round nozzles to obtain a multifilament yarn, where the nozzles have a rectangular cross section; iii) coagulating the multifilament yarn in an aqueous solution, iv) combining at least two of the obtained multifilament yarns.

8. Cord of claim 1, wherein the cross-sectional aspect ratio between the larger dimension and the smaller dimension is in the range from 2.5 to 6.

* * * * *